US011206913B2

(12) United States Patent
Sanchez et al.

(10) Patent No.: US 11,206,913 B2
(45) Date of Patent: Dec. 28, 2021

(54) APPLICATOR FOR APPLYING A PRODUCT TO EYELASHES OR EYEBROWS

(71) Applicant: L'OREAL, Paris (FR)

(72) Inventors: Marcel Sanchez, Aulnay sous Bois (FR); Wendy Annonay, Paris (FR); Audrey Thenin, Meudon (FR); Eric Caulier, Maignelay (FR)

(73) Assignee: L'OREAL, Paris (FR)

( * ) Notice: Subject to any disclaimer, the term of this patent is extended or adjusted under 35 U.S.C. 154(b) by 62 days.

(21) Appl. No.: 14/900,427

(22) PCT Filed: Jun. 19, 2014

(86) PCT No.: PCT/IB2014/062438
§ 371 (c)(1),
(2) Date: Dec. 21, 2015

(87) PCT Pub. No.: WO2014/203196
PCT Pub. Date: Dec. 24, 2014

(65) Prior Publication Data

US 2016/0143418 A1 May 26, 2016

(30) Foreign Application Priority Data

Jun. 19, 2013 (FR) ..... 13 55783

(51) Int. Cl.
*A45D 40/26* (2006.01)
*A46B 9/02* (2006.01)

(52) U.S. Cl.
CPC ..... *A45D 40/265* (2013.01); *A46B 9/021* (2013.01); *A46B 2200/106* (2013.01)

(58) Field of Classification Search
CPC .. A45D 40/262; A45D 40/265; A45D 40/267; A46B 9/021; A46B 2200/106
See application file for complete search history.

(56) References Cited

U.S. PATENT DOCUMENTS 6,343,607 B1 2/2002 Gueret
8,042,555 B2 * 10/2011 Neuner ..... A45D 40/265 132/218

(Continued)

FOREIGN PATENT DOCUMENTS

CN 1302576 A 7/2001
CN 101835402 A 9/2010

(Continued)

OTHER PUBLICATIONS

Aug. 6, 2014 International Search Report issued in International Patent Application No. PCT/IB2014/062438.
Dec. 19, 2015 Written Opinion issued in International Patent Application No. PCT/IB2014/062438.

(Continued)

*Primary Examiner* — Cris L. Rodriguez
*Assistant Examiner* — Brianne E Kalach
(74) *Attorney, Agent, or Firm* — Oliff PLC

(57) ABSTRACT

The invention relates to an applicator for applying a product to eyelashes and/or eyebrows, comprising an application body produced by material moulding, said application body comprising: a core extending along a longitudinal axis; and spikes (12) carried by the core, having a convex polygonal cross-section with at least six sides, two opposite sides (12*b*) of which are oriented substantially perpendicularly to the longitudinal axis of the core.

19 Claims, 3 Drawing Sheets

(56) References Cited

U.S. PATENT DOCUMENTS

Figure 1:
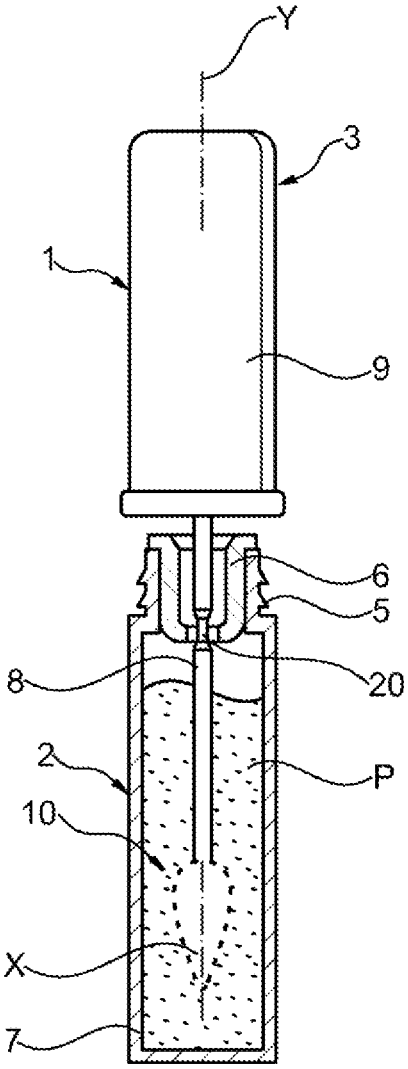

D656,739 S * 4/2012 Edmondson ..... D4/128
2006/0289027 A1* 12/2006 Wyatt ..... A46B 1/00 132/218
2007/0033759 A1* 2/2007 Dumler ..... A45D 40/262 15/187
2007/0062552 A1* 3/2007 De Brouwer ..... A45D 34/045 132/218
2008/0178901 A1* 7/2008 Montoli ..... A45D 40/262 132/218
2008/0286030 A1* 11/2008 Roder ..... A45D 34/042 401/129
2010/0037911 A1* 2/2010 Kim ..... A45D 40/262 132/218
2010/0310295 A1 12/2010 Gueret
2011/0083693 A1* 4/2011 Gueret ..... A45D 40/267 132/202
2011/0168204 A1* 7/2011 Gueret ..... A45D 40/265 132/218
2012/0039658 A9 2/2012 Gueret
2012/0294664 A1* 11/2012 Gueret ..... A46B 9/021 401/118
2013/0036565 A1 2/2013 Gueret

FOREIGN PATENT DOCUMENTS

CN 102802463 A 11/2012
EP 1767118 A1 3/2007
FR 2968519 A1 6/2012
FR 2983689 A1 6/2013
WO 2006/125122 A1 11/2006
WO WO2009053922 * 4/2009
WO 2012/001580 A1 1/2012
WO 2012/080936 A2 6/2012

OTHER PUBLICATIONS

Jun. 15, 2017 Office Action issued in Chinese Patent Application No. 201480035083.6.

Aug. 10, 2017 Supplement to Third Party Observation filed in European Application No. 14737006.8.

* cited by examiner

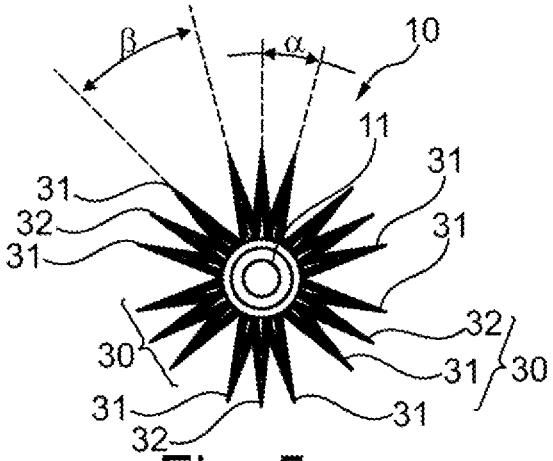
Fig. 5
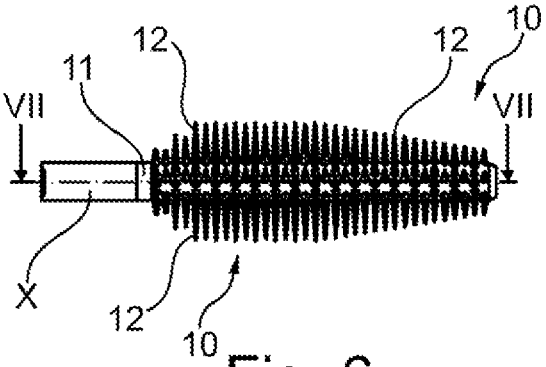
Fig. 6
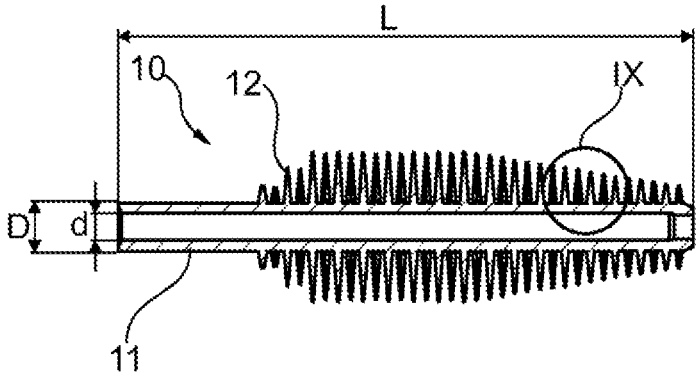
Fig. 7
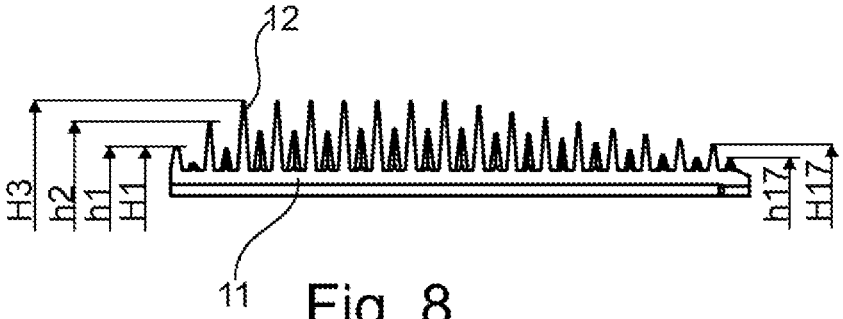
Fig. 8
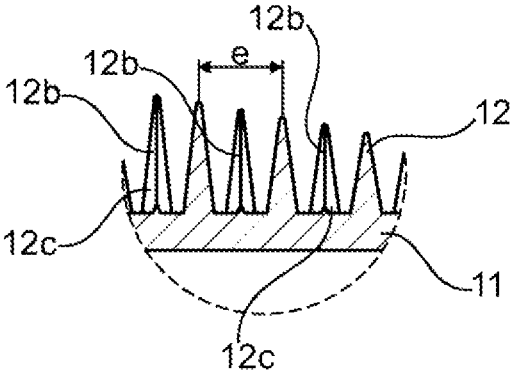
Fig. 9
| Height of the teeth: | |
|---|---|
| Type A: | Type B: |
| H1: 1 | h1:1 |
| H2: 1.94 | h2:1.50 |
| H3 to 9:2.88 | h3 to 10:2 |
| H10: 2.65 | h11: 1.88 |
| H11: 2.41 | h12: 1.75 |
| H12: 2.18 | h13: 1.63 |
| H13: 1.94 | h14: 1.50 |
| H14: 1.71 | h15: 1.38 |
| H15: 1.47 | h16: 1.25 |
| H16: 1.24 | h17: 1.13 |
| H17: 0.95 | |
Fig. 10

APPLICATOR FOR APPLYING A PRODUCT TO EYELASHES OR EYEBROWS

The present invention relates to applicators for applying a cosmetic, makeup or care, product to the eyelashes and/or eyebrows.

The invention relates more particularly to applicators having an applicator member that is produced by molding material, in particular thermoplastic, and is disposed at the end of a stem that is connected at the other end to a gripping member that can also constitute a closure member for a container containing the product to be applied.

There is a need to further improve the performance of such applicators, in particular in terms of comfort during application, and loading and separating the eyelashes.

A subject of the invention, according to one of its aspects, is an applicator for applying a product to the eyelashes and/or eyebrows, having an applicator member that is produced by molding material, this applicator member having:

a core that extends along a longitudinal axis, spikes that are carried by the core and have a convex polygonal cross section with at least six sides, two opposite sides of which are oriented substantially perpendicularly to the longitudinal axis of the core.

The cross section of the spikes is preferably hexagonal, and even more preferably in the shape of a regular hexagon.

The spikes can advantageously have a hexagonal cross section over more than half of their height, better still over substantially their entire height.

The spikes may be truncated at their tips.

The use in the invention of spikes with a polygonal cross section oriented so as to have sides more or less perpendicular to the longitudinal axis of the core affords the advantage of providing a larger surface area of contact with the eyelashes, since the eyelashes introduced between the spikes in a transverse direction with respect to the longitudinal axis of the core can come into contact with these sides which are more or less parallel to said eyelashes. Preferably, the spikes have opposite lateral ridges that are situated in a plane perpendicular to the longitudinal axis of the core. These lateral ridges tend to make it easier to insert the eyelashes between the spikes and can improve the combing action carried out by the applicator member on the eyelashes.

Preferably, the spikes are distributed over the core in spike alignments that extend in the longitudinal direction of the core.

When the applicator is seen from the side, there is preferably an alternation of circumferentially extending crowns of spikes, with a different number of spikes from one crown to another. There is preferably an alternation of crowns in the longitudinal direction with crowns having $n_1$ spikes alternating with crowns having $n_2$ spikes, where $n_2>n_1$, and preferably $n_2=2\ n_1$. The spikes in a given crown, in particular the one having $n_1$ spikes, are preferably situated between those in the following crown that has $n_2$ spikes, when the applicator member is seen along its axis.

The spikes can be disposed in groups of three alignments in the longitudinal direction, with one group per face of the core.

Such an applicator member has a good capability of combing the eyelashes and separating them by using the groups of spike alignments. The spaces formed between the crowns of spikes can contain reserves of product, which are useful for loading the eyelashes. The orientation of the spikes then makes it possible to separate them properly.

The expression "sides oriented substantially perpendicularly to the longitudinal axis of the core" should be understood as meaning that the sides make an angle of 90°±30°, better still 90°±20°, even better still 90°±10°, with the longitudinal axis of the core.

Preferably, each group of spike alignments has three spike alignments, as mentioned above.

Each group of spike alignments preferably has two spike alignments with spikes of the same rank having one and the same height, at least for some of the spikes in these alignments.

The rank of a spike is counted from the first spike, which is closest, within a spike alignment, from the distal end of the applicator member.

At least one group of spike alignments, better still each group, can have two identical spike alignments. The spike alignments can be mirror images of one another by rotation about the longitudinal axis of the core.

Each spike alignment can have spikes of the same height, for a range of values of ranks within this alignment. Within one group of spike alignments, the ratio $h_{max}/h_{min}$ between the tallest spike and the shortest spike of the same rank in a different alignment can be between 1 and 1.5, better still between 1 and 1.35. The envelope surface defined by the free ends of the spikes can have various shapes along at least a portion of the length of the applicator member, in particular a conical, cylindrical or cylindrical conical shape, with a circular or noncircular, ogival, ovoid, peanut-shaped, fish-shaped, spiral-shaped, etc., cross section.

The core may be hollow or solid.

Preferably, the spikes extend radially.

The number of spikes carried by the core may be greater than or equal to 300, with for example between 10 and 30 spikes per spike alignment, better still between 15 and 20 spikes.

The offset between the axes of the spikes, measured within one and the same alignment, may be between 1.3 and 1.6 mm, better still between 1.4 and 1.5 mm. The offset between two successive crowns, measured between the planes containing the axes of the spikes, perpendicularly to the longitudinal axis of the core, may be between 0.6 and 0.9 mm, better still between 0.7 and 0.8 mm. The angular offset $\beta$ between two adjacent groups of spike alignments may be between 25° and 35°, and the angular offset $\alpha$ between two spike alignments within one group of spike alignments may be between 12.5 and 17.5°. The angular offset is measured between the radial planes which contain the tips of the spikes in the alignments in question. If the tips of the spikes in one and the same alignment are not coplanar, for example because they are disposed in somewhat staggered rows, the plane which is taken as the reference to measure the angular offset is a longitudinal median plane for this alignment.

A further subject of the invention, according to another of its aspects, is a device for packaging and applying a cosmetic product, having:

a container containing the product to be applied, an applicator according to the invention, as defined above.

A further subject of the invention, according to another of its aspects, is a method for making up the eyelashes and/or eyebrows, comprising the application of a product to the eyelashes and/or the eyebrows with the aid of an applicator according to the invention.

Figure 2:
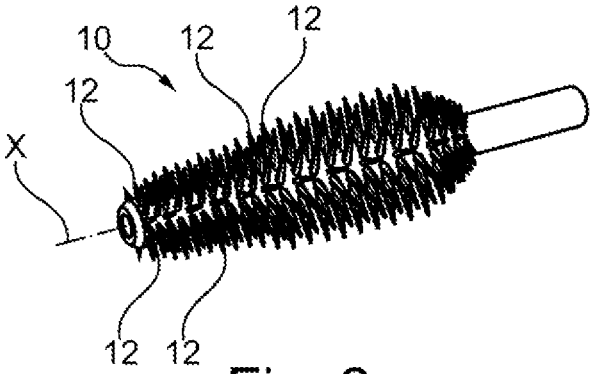
Figure 3:
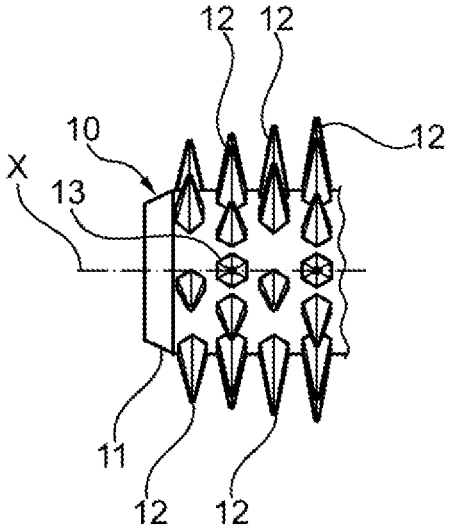
Figure 3A:
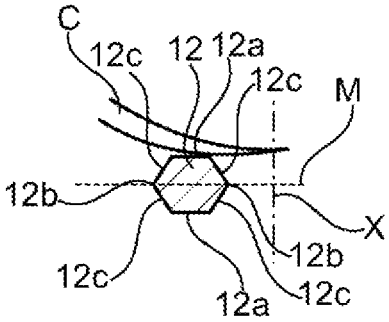
Figure 4:
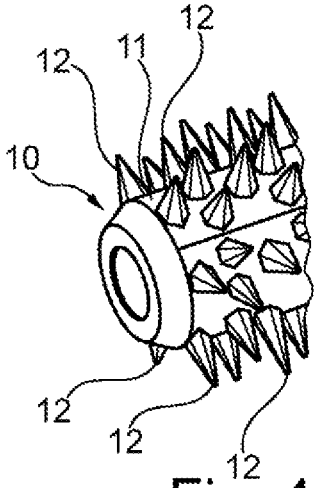
Figure 11:
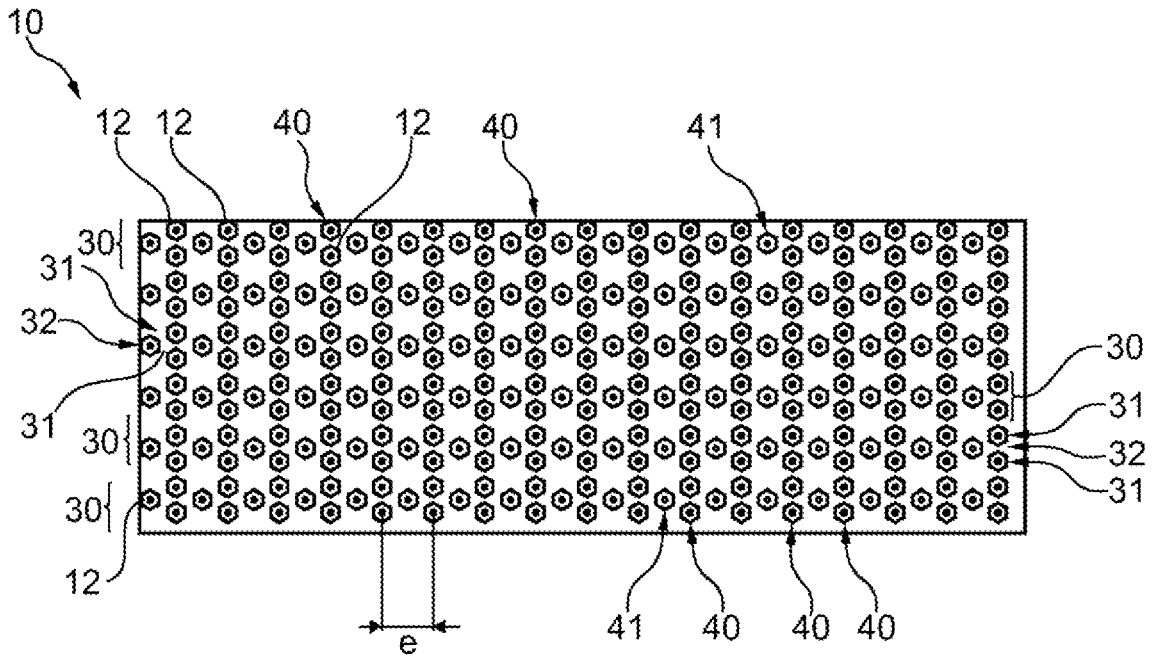

The invention may be better understood from reading the following detailed description of nonlimiting illustrative embodiments thereof and from examining the appended drawing, in which:

FIG. 1 schematically shows, in longitudinal section, an example of a packaging and application device produced in accordance with the invention, FIG. 2 schematically shows a perspective view of the applicator member of the applicator from FIG. 1 on its own, FIGS. 3 and 4 are views on an enlarged scale of embodiment details of the applicator member from FIG. 1, FIG. 3A shows a spike in cross section, on its own, FIG. 5 is a front view, along the longitudinal axis of the core, of the applicator member, FIG. 6 is a side view of the applicator member, FIG. 7 is a section on VII-VII in FIG. 6, FIG. 8 schematically illustrates two spike alignments, showing the respective heights of the spikes in these two alignments, FIG. 9 corresponds to the detail IX in FIG. 7, FIG. 10 is a table showing an example of heights of spikes depending on the rank, for two types of spike alignments within one group of spike alignments, and FIG. 11 is a developed view of the surface of the core and the spikes, illustrating the implantation of the latter.

The packaging and application device 1 shown in FIG. 1 has a container 2 containing a product P to be applied to the eyelashes and/or eyebrows and an applicator 3 which may be fixed removably to the container 2.

The applicator 3 has a stem 8 of longitudinal axis Y, which is provided at one end with an applicator member 10, which will be described in detail below, and at the other end with a gripping member 9 that likewise forms a cap for closing the container 2 in a sealed manner. The latter has a body 7 which is provided at the top with a threaded neck 5 onto which the gripping member 9 can be screwed in order to close the container 2 in a sealed manner. In a variant, the applicator 3 can be fixed to the container 2 in some other way.

The neck 5 may accommodate, as illustrated, a wiping member 6 which is for example inserted into the neck 5. This wiping member 6 has for example a lip that defines a wiping orifice having a diameter adapted to that of the stem 8. The wiping member 6 may be of any type, attached to the container 2 or moulded together therewith. The wiping member 6 may also be adjustable. In a variant, the neck 5 of the container 2 may be attached.

In the example illustrated, the stem 8 has a rectilinear longitudinal axis Y, but if the stem 8 is not rectilinear, this does not depart from the scope of the present invention.

As illustrated, the stem 8 may have an annular narrowing 20, which is positioned opposite the lip of the wiping member 6 when the applicator 3 is fixed on the container 2.

The product P is intended to be applied to the eyelashes and/or eyebrows. It may comprise iron oxide, among other pigments, and an aqueous or organic solvent, depending on the formulation.

The applicator member 10 has been shown on its own in FIGS. 2 to 9. Said applicator member has a core 11 of longitudinal axis X, carrying application elements 12 that are constituted by spikes.

The core 11 is extended by an end piece 13 which lies in continuation of the stem 8.

In the example in question, the core 11 is hollow, and the stem 8 may have an end pin which is inserted into the core 11 as far as its distal end. This makes it possible to stiffen the core, in particular when the applicator member 10 is made of a particularly flexible material.

The length L of the applicator member 10 is for example between 30 and 35 mm. The outside diameter D of the core 11 is for example between 2.5 and 3 mm, for an inside diameter d of for example between 1.4 and 1.6 mm.

In accordance with the invention, the spikes 12 have a hexagonal cross section, with opposite sides 12*a* oriented substantially perpendicularly to the core X, as can be seen in particular in FIG. 3A. The cross section of the spike is a section in a plane perpendicular to the elongation axis of this spike.

Thus, in cross section, the sides 12*a* can each be contained in a plane perpendicular to the axis X.

Preferably, the section is in the form of a regular hexagon, and each spike 12 has lateral ridges 12*b* situated in a median plane M for the tooth 12, perpendicular to the axis X.

When an eyelash C is inserted between the spikes 12, as illustrated, it can come into contact with one side 12*a* along more or less the entire length of this side, and the surface area of contact between the tooth and the eyelash is thus relatively large, thereby making it possible to improve the deposition and smoothing action of the product on the surface of the eyelash. On account of the disposition of the ridges 12*b*, the sides 12*c* adjacent to the ridges 12*b* can displace the eyelashes towards the spaces between the spikes 12, thereby making it easier for the eyelashes to pass between the spikes 12.

As illustrated in particular in FIGS. 5 and 11, the spikes 12 can be organized in spike alignments in the longitudinal direction, these being grouped in groups 30 of three, as can be seen in FIG. 5.

Each group 30 has two spike alignments 31 of a first type A and one spike alignment 32 of a second type B.

The angular offset $\alpha$ between two spike alignments within one group 30, measured between the planes containing the axes of the spikes, which are oriented radially, is less than the angular offset $\beta$ between two adjacent groups 30, measured between the planes containing the axes of the spikes in the alignments that are closest to one another, belonging to these two groups.

For example, $\alpha=15°$ and $\beta=30°$.

Within one spike alignment 31 or 32, according to the rank of the spike, the height of the spike can vary.

By way of example, the heights h and H of the spikes for the alignments 31 and 32 of types A and B, respectively, starting from the first spike situated at the distal end of the applicator member, have been indicated in the table in FIG. 10. The values are expressed in mm.

The offset e between the axes of the spikes, within one alignment, may be between 1.3 and 1.6 mm, and is for example around 1.5 mm.

When the applicator member 10 is seen from the side, as in FIGS. 6 and 7, the spikes 12 form crowns 40 and 41 that extend in the circumferential direction around the longitudinal axis X of the core 11.

The number of spikes per crown has higher values for the crowns 40, for example 12 spikes, which alternate with lower values, for example 6 spikes, for the crowns 41.

The core 11 may have flat longitudinal faces.

The applicator member is advantageously produced from a thermoplastic material, in particular an elastomer, for example SEBS, a silicone, latex, butyl, EPDM, a nitrile, a thermoplastic elastomer, a polyester elastomer, a polyamide elastomer, a polyethylene elastomer or a vinyl elastomer, a polyolefin such as PE or PP, PVC, EVA, PS, PET, POM, PA or PMMA. It is possible in particular to use the materials known under the trade names Hytrel®, Cariflex®, Alixine®, Santoprene®, or Pebax®, this list not being limiting.

The spikes 12 may comprise a material that has bacteriostatic properties and/or promotes slip and/or is magnetic.

The applicator 3 may be subjected to vibrations during use, and/or be heated, that is to say have a heating element, and/or be able to rotate. It is also possible for the applicator member 10 to be able to vibrate and to be heated or only to be able to vibrate or only to be heated or only to be able to rotate. When the applicator is able to rotate, the gripping member 9 may house an electric motor for rotating the stem.

The spikes 12 may be arranged in other dispositions of spikes than those illustrated in the figures.

It is possible for the applicator member 10 to have only spikes with a hexagonal cross section or, as a variant, to have both spikes with a hexagonal cross section and spikes with a cross section that is not hexagonal, for example non-polygonal, in particular circular.

It is possible for the polygonal section of the spikes 12 not to be regular. Preferably, in this case, the sides 12*a* are larger than the other sides, thereby making it possible to increase the surface area of contact with the eyelashes.

The expression "having a" should be understood as being synonymous with "having at least one".

The invention claimed is:

1. An applicator for applying a product to the eyelashes and/or eyebrows, having an applicator member that is produced by molding material, this applicator member having:

a core that extends along a longitudinal axis, spikes that are carried by the core and have a convex polygonal cross section with at least six sides, two opposite sides of which are oriented substantially perpendicularly to the longitudinal axis of the core, making an angle of 90°±10° with the longitudinal axis of the core, the applicator having, when viewed from the side in a direction perpendicular to the longitudinal axis of the core, a series of circumferentially extending crowns, the number of spikes in one crown being different from that in an adjacent crown, crowns having $n_1$ spikes alternating in the longitudinal direction with crowns having $n_2$ spikes, where $n_2=2*n_1$, the spikes in a given crown appearing to be situated between those in a following crown when the applicator member is seen along the longitudinal axis of the core, the spikes being distributed over the core in spike alignments that extend in a longitudinal direction of the core, the alignments being grouped around the core in groups of alignments, and the applicator presenting, when viewed along the longitudinal axis of the core, groups of alignments all identical.

2. The applicator as claimed in claim 1, wherein the cross section of the spikes is hexagonal.

3. The applicator of claim 2, wherein the cross section is in the shape of a regular hexagon.

4. The applicator as claimed in claim 1, wherein the spikes have a hexagonal cross section over substantially their entire height.

5. The applicator as claimed in claim 1, wherein the spikes are truncated at their tips.

6. The applicator as claimed in claim 5, wherein each alignment of spikes has spikes of the same height for a range of values of ranks within this alignment.

7. The applicator as claimed in claim 1, wherein the spikes have opposite lateral ridges that are situated in a plane perpendicular to the longitudinal axis of the core.

8. The applicator as claimed in claim 1, wherein the spikes are distributed over the core in spike alignments that extend in the longitudinal direction of the core, the alignments being grouped around the core in groups of alignments.

9. The applicator as claimed in claim 8, wherein each group of spike alignments has spikes, of the same rank within the alignments of this group, which have different heights.

10. The applicator as claimed in claim 9, wherein each group of spike alignments has three spike alignments.

11. The applicator as claimed in claim 8, wherein each group of spike alignments has two spike alignments with spikes of the same rank having one and the same height, at least for some of the spikes in the alignments.

12. The applicator as claimed in claim 8, wherein at least one group of spike alignments has two identical spike alignments.

13. The applicator as claimed in claim 8, wherein, within one group of spike alignments, a ratio $h_{max}/h_{min}$ between the tallest spike and the shortest spike, of the same rank, in a different alignment, is between 1 and 1.5.

14. The applicator as claimed in claim 1, wherein the core is hollow.

15. The applicator as claimed in claim 1, wherein the spikes extend radially.

16. A device for packaging and applying a cosmetic product, having:

a container containing the product to be applied, an applicator as defined in claim 1.

17. An applicator for applying a product to the eyelashes and/or eyebrows, having an applicator member that is produced by molding material, this applicator member having:

a core that extends along a longitudinal axis, spikes that are carried by the core and have a convex polygonal cross section with at least six sides, two opposite sides of which are oriented substantially perpendicularly to the longitudinal axis of the core, making an angle of 90°±10° with the longitudinal axis of the core, the applicator having, when viewed from the side in a direction perpendicular to the longitudinal axis of the core, a series of circumferentially extending crowns, the number of spikes in one crown being different from that in an adjacent crown, wherein the spikes are distributed over the core in spike alignments that extend in the longitudinal direction of the core, the alignments being grouped around the core in groups of alignments, each group of spike alignments having only three spike alignments, wherein two groups being angularly separated by an angular offset, about the longitudinal axis of the core, that is greater than the angular offset between two adjacent alignments within one and the same group, and wherein the applicator presents, when viewed along the longitudinal axis of the core, groups of alignments all identical.

18. An applicator for applying a product to the eyelashes and/or eyebrows, having an applicator member that is produced by molding material, this applicator member having:

a core that extends along a longitudinal axis, spikes that are carried by the core and have a convex polygonal cross section with at least six sides, two opposite sides of which are oriented substantially perpendicularly to the longitudinal axis of the core, making an angle of 90°±10° with the longitudinal axis of the core, the applicator having, when viewed from the side in a direction perpendicular to the longitudinal axis of the core, a series of circumferentially extending crowns, the number of spikes in one crown being different from that in an adjacent crown, wherein the spikes are distributed over the core in spike alignments that extend in the longitudinal direction of the core, the alignments being grouped around the core in groups of alignments, each group of spike alignments having only three spike alignments and a non-zero angular offset between two adjacent alignments within one and the same group, the angular offset being measured between the planes containing the axes of the spikes.

19. The applicator as claimed in claim 18, wherein the applicator presents, when viewed along the longitudinal axis of the core, six groups of alignments.

* * * * *